United States Patent [19]

Hacker, Jr.

[11] 4,074,885

[45] Feb. 21, 1978

[54] CEILING SUPPORT CLIP

[76] Inventor: Walter L. Hacker, Jr., 2221 Patty Lane, Green Bay, Wis. 54304

[21] Appl. No.: 738,018

[22] Filed: Nov. 2, 1976

[51] Int. Cl.[2] ..... B42F 13/00; A44B 21/00

[52] U.S. Cl. ..... 248/317; 24/73 C; 24/73 AS; 24/73 GS; 24/261 R

[58] Field of Search ..... 24/73 CP, 73 C, 73 AS, 24/73 GS, 261 C, 261 DS, 261 WL, 261 B, 261 R; 248/318, 317

[56] References Cited

U.S. PATENT DOCUMENTS

| | | | |
|---|---|---|---|
| 341,856 | 5/1886 | Proctor | 24/261 B |
| 1,105,855 | 8/1914 | Smith | 24/73 CP |
| 1,395,071 | 10/1921 | Wentzell | 52/360 |
| 1,423,119 | 7/1922 | King | 24/73 CP |
| 1,878,497 | 9/1932 | Lehr | 24/261 C |
| 3,327,376 | 6/1967 | Freeman | 24/261 C |
| 3,601,862 | 8/1971 | Hargadon | 24/73 B |
| 3,936,913 | 2/1976 | Weissman | 24/73 C |

FOREIGN PATENT DOCUMENTS

| | | | |
|---|---|---|---|
| 590,565 | 7/1947 | United Kingdom | 24/261 R |

*Primary Examiner*—Bernard A. Gelar

[57] ABSTRACT

A ceiling support clip formed of wire and adapted to be removably secured to a ceiling post comprising a spring loop at one end of the clip, with a pair of arms diverging forwardly from the loop to provide finger grips. Each arm includes a lower section extending outwardly from the loop, and an upper section being extended in forwardly converging relation and crossing adjacent the front end thereof, with gripping jaws formed on the front ends of the upper sections and including a gripping element extending in a plane substantially normal to the plane of the arms and adapted to move towards and away from each other as the arms are compressed and released to engage the ceiling post and suspend the support clip therefrom. Each jaw includes a bridge section extending angularly from the front end to one end of the gripping element and a tail section extending angularly from the other end of the gripping element and terminating in a free end.

3 Claims, 5 Drawing Figures

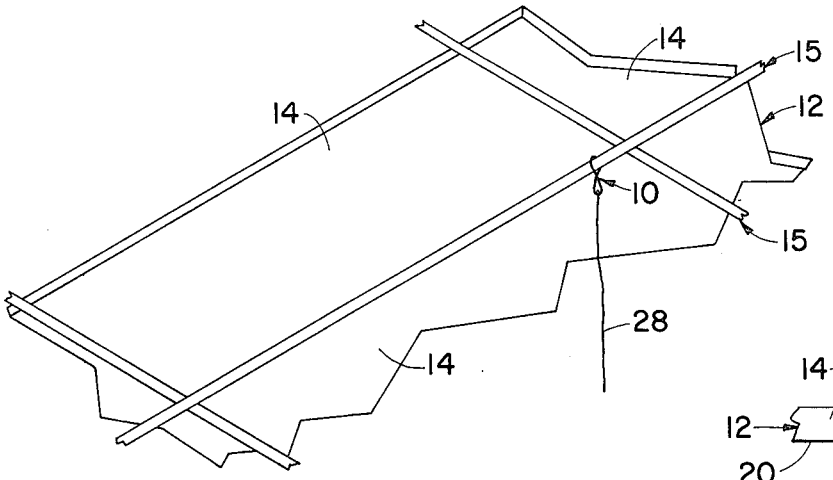
FIG. 1
FIG. 3
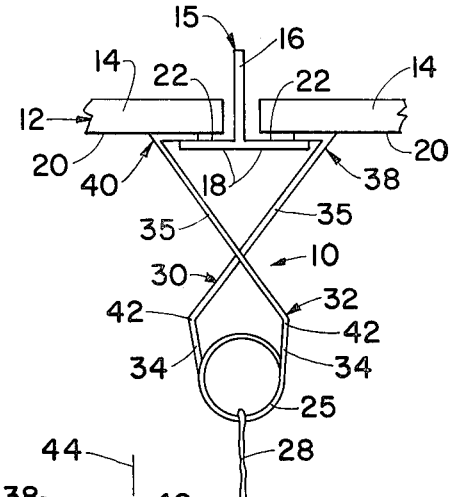
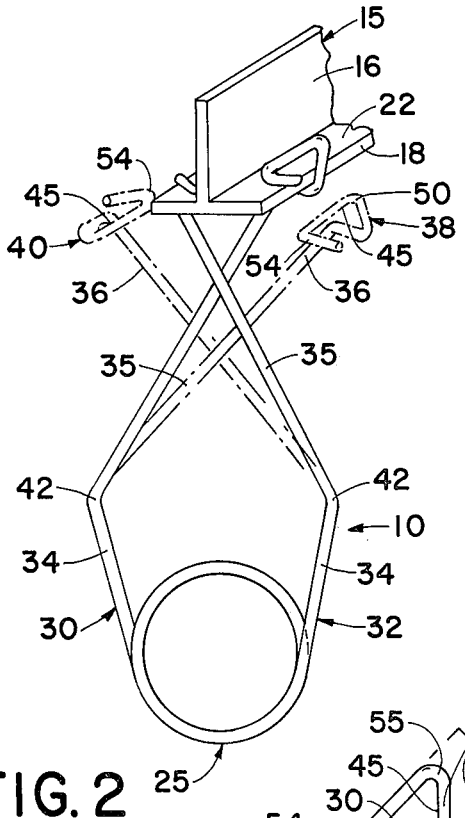
FIG. 2
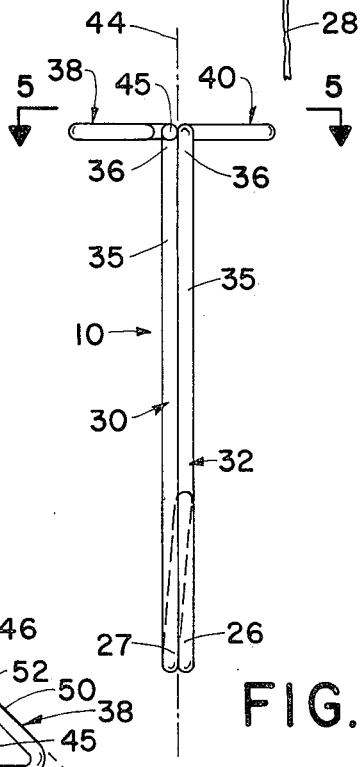
FIG. 4
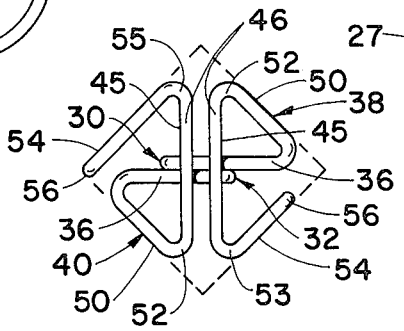
FIG. 5

CEILING SUPPORT CLIP

BACKGROUND OF THE INVENTION

The present invention relates to a ceiling support clip, or the like.

Resilient support clips or securing devices are well known in the art and various constructions thereof are illustrated in U.S. Pat. Nos. 2,159,026; 2,284,004; 2,585,089; 2,653,048; 3,530,545; and 3,704,487. I have found that these prior art devices are unsatisfactory when one wishes to attach or hang various items from the T-posts used for mounting of ceiling panels. In order to provide the necessary support from the ceiling panel, I have found that a gripping jaw having a substantial width is required in order to be able to hang plants, posters, etc.

OBJECTS OF THE INVENTION

An object of the present invention is to provide a support clip formed of wire and adapted to be removably secured to a ceiling post.

Another object of the present invention is to provide a ceiling support clip that can be economically produced and that will provide a firm, safe, support to give long years of useful service.

Another object of the present invention is to provide a ceiling support clip in which the jaws are easily opened and readily closed around the ceiling post.

Other objects and advantages of the present invention will become apparent as the disclosure proceeds.

SUMMARY OF THE INVENTION

A ceiling support clip formed of wire and adapted to be removably secured to a ceiling post, comprising a spring loop at one end of the clip, with a pair of arms diverging forwardly from the loop to provide finger grips. Each arm includes a lower section extending outwardly from the loop, and an upper section being extended in forwardly converging relation and crossing adjacent the front end thereof, with gripping jaws formed on the front ends of the upper sections and including a gripping element extending in a plane substantially normal to the plane of the arms and adapted to move towards and away from each other as the arms are compressed and released to engage the ceiling post and suspend the support clip therefrom.

Each jaw includes a bridge section extending angularly from the front end to one end of the gripping element and a tail section extending angularly from the other end of the gripping element and terminating in a free end. The gripping element, bridge section, and tail section all extend in a substantially horizontal plane relative to the vertical axis of the clip, and the respective bridge sections of each arm extend in parallel spaced relationship to each other.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1 is a perspective view of a ceiling with the support clip in position thereon;

FIG. 2 is a perspective view of the support clip of the present invention in position on the ceiling post;

FIG. 3 is a side view illustrating the clip in position on the ceiling post;

FIG. 4 is a plan view of the support clip; and

FIG. 5 is a top plan view taken along line 5—5 of FIG. 4.

DETAILED DESCRIPTION OF THE DRAWINGS

Referring now to the drawings, there is illustrated in FIGS. 1–5 a support clip 10 adapted to be used in conjunction with a ceiling 12. The construction of the ceiling 12 includes a plurality of panels 14 that are hung from or suspended from posts 15 having a general T-shaped configuration. Each post 15 includes a vertical portion 16 that extends between the panels 14 and a pair of flanges 18 on which the panel 14 rests.

The above type of construction for ceilings is well known today and is used in many commercial establishments. The problem has been, how to attach or suspend something from the ceiling 12. The panels 14 are made from a sound absorbing material, and drilling a hole therein would permanently damage same. Accordingly, I have invented the clip 10 which rests between the outer surface 20 of the panel and the inner edge 22 of the flange 18. In this manner the clip 10 grips each of the inner edges 22 of a particular channel 15.

The ceiling support clip 10 may be formed from a continuous section of wire and is adapted to be removably secured to the ceiling post 15. A spring loop 25 is formed at one end of the clip 10 and may include one or more circular loops. Two loops being illustrated with the wire formed into loop portion 26 and loop portion 27 in overlapping relationship to each other. A thread or other fastener 28 may extend downwardly from the loop portion 25 for hanging a particular item therefrom.

A pair of arms 30 and 32 diverging forwardly from the loop 25 provide the necessary finger grips for movement of the arms 30 and 32 between the respective positions illustrated in FIG. 2. Each arm 30 and 32 may include a lower section 34 extending outwardly from the loop and an upper section 35 being extended in forwardly coverging relation and crossing adjacent the front or forward end 36 of each arm 30 and 32.

Gripping jaws 38 and 40 are provided with arms 30 and 32 respectively. The jaws 38 and 40 are separated from each other in order to grip the flanges 18 by applying a compressor force to the upper section 35. As particularly seen in FIGS. 2 and 3, the upper sections 35 are formed into a V-shaped configuration above the crossing therebetween. The lower sections 34 extend outwardly from the loop 25 until the junction point 42 and thereafter are bent inwardly in order to provide the necessary spacing at the jaws 38 and 40.

Each of the gripping jaws 38 and 40 extend in a plane substantially normal to the vertical axis 44 of the clip 10. The jaws 38 and 40 include a gripping element 45 having an upper edge or surface 46. The gripping elements 45 are adapted to move towards and away from each other as the arms 30 and 32 are compressed and released to engage the ceiling post or channel 15 and suspend the support clip 10 therefrom. Each jaw 38 and 40 further includes a bridge section 50 extending angularly from the front end 36 of each arm 30 and 32, and connected to one end 52 of each gripping element 45. A tail section 54 is provided and extends angularly from the other end 55 of each gripping element 45 and terminating in a free end 56.

Each gripping element 45, bridge section 50, and tail section 54 all extend in a substantially horizontal plane relative to the vertical axis 44 of the clip 10. In addition, the respective bridge sections 50 extend in parallel spaced relationship to each other. Also, the respective tail sections 54 extend in parallel spaced relationship to each other. Thereby, the tail sections 54 and bridge sections 50 form a rectangular configuration.

By providing gripping elements 45 that extend in parallel spaced relationship to each other, they are moved to the open position illustrated in FIG. 2 and are then contained between the surface 22 of flanges 18 and the lower surface 20 of each panel 14. The respective jaws 38 and 40 have a triangular configuration thereto. The gripping element 45 is designed to be sufficiently wide to present a large enough area from which to be suspended to assure proper retention and support for the object to be suspended therefrom. The arms 30 and 32 may extend in abutting relationship to each other upwardly from the loop 25.

Accordingly, there has been illustrated a clip 10 that is ideally suited for use with ceiling supports and solves the presently existing problem that is faced by many individuals in commercial locations.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A ceiling support clip formed of wire and adapted to be removably secured to a ceiling post, comprising:

a. a spring loop at one end of the clip, b. a pair of arms diverging forwardly from said loop to provide finger grips, each said arm including a lower section extending outwardly from said loop, and an upper section being extended in forwardly converging relation and crossing adjacent the front end thereof; and said upper sections of said arms being compressed to open said jaws with said upper sections formed into a V-shaped configuration above the crossing therebetween, c. gripping jaws formed on said front ends of said upper sections and including a gripping element extending in a plane substantially normal to the plane of said arms and adapted to move towards and away from each other as said arms are compressed and released to engage the ceiling post and suspend the support clip therefrom, said jaw including a bridge section extending angularly from said front end to one end of said gripping element and a tail section extending angularly from the other end of said gripping element and terminating in a free end, d. said gripping element, bridge section, and tail section all extend in a substantially horizontal plane relative to the vertical axis of the clip, and e. said respective bridge sections of each said arm extend in substantially parallel spaced relationship to each other, with said respective tail sections of each said arm extending in substantially parallel spaced relationship to each other, and said gripping elements extending in substantially parallel spaced relationship to each other such that each said jaw forms a substantially triangular configuration.

2. A ceiling support clip as in claim 1, wherein said respective tail sections and bridge section form a rectangular configuration.

3. A ceiling support clip as in claim 1, wherein each said arm extends in abutting relationship to each other upwardly from said loop.

* * * * *